US005383004A

United States Patent [19]

Miller et al.

[11] Patent Number: 5,383,004

[45] Date of Patent: Jan. 17, 1995

[54] NORMALIZING SHEET COUNT TO PREDICT HARDWARE REPLACEMENT INTERVALS

[75] Inventors: Donald L. Miller, Penfield; William M. Ouyang, Pittsford; Phillip E. Chapman, Fairport, all of N.Y.

[73] Assignee: Xerox Corporation, Stamford, Conn.

[21] Appl. No.: 119,553

[22] Filed: Sep. 13, 1993

[51] Int. Cl.[6] ..... G03G 15/00

[52] U.S. Cl. ..... 355/206; 355/308

[58] Field of Search ..... 355/202, 204, 206, 209, 355/308, 311, 201, 208

[56] References Cited

U.S. PATENT DOCUMENTS 4,860,052 8/1989 Ito et al. ..... 355/209

5,117,258 5/1992 Iwata ..... 355/201

5,184,179 2/1993 Tarr et al. ..... 355/206

*Primary Examiner*—Joan H. Pendegrass

*Attorney, Agent, or Firm*—Ronald F. Chapuran

[57] ABSTRACT

A method of normalizing the count in a counter depending upon the type or size of the copy sheets processed in an electronic image processing machine including the steps of determining the size or type of copy sheets in process in the machine, recording a count in the counter in response to the size or type of copy sheets in process, normalizing the count in the counter as a function of the change in size or type of the copy sheets in process, and relating the normalized counts to the need to replace selected components of the image processing machine.

15 Claims, 7 Drawing Sheets

NORMALIZING SHEET COUNT TO PREDICT HARDWARE REPLACEMENT INTERVALS

BACKGROUND OF THE INVENTION

The invention relates to machine maintenance, and more particularly, to a technique for increasing the prediction accuracy for hardware replacement before hardware failure.

As electronic imaging machines such as copiers and printers become more complex and versatile in operation with greater speed and copy output required, there is a greater demand for higher performance and reliability. A suitable control must be able to not only coordinate the operation of the various components of the machine but be able to internally diagnose and monitor machine operation and provide suitable data and service prompts for routine and orderly component replacement, maintenance, and repair without costly and unexpected machine break downs. In complex machines, the challenge to avoid time consuming and unscheduled component replacement and maintenance becomes even more critical.

In the prior art, attempts to predict needed machine maintenance and component replacement usually include counters to record machine volume, such as the number of images projected or the number of copy sheets processed. A service representative routinely monitors the machine volume to predict the need for component replacement such as the need to replace the photoreceptor, fuser rolls, or the development system after a given number of copy sheets processed.

A difficulty with the prior art systems is that mere image counts or copy sheet counts are often an unreliable predictor of component wear because of sizes and types of copy sheets. For example, a machine primarly processing a first size copy sheet, for example, 8½ by 11 sheets will generally require component replacement at certain copy sheet counts for the various components. On the other hand, the same machine primarily processing a second size copy sheet, for example, 17 by 11 sheets, will generally require component replacement at different copy sheet counts. The reason is that 17 by 11 sheets, in the long run, usually inflict more wear on system components than an 8½ by 11 sheet. In addition, the specific count, indicating the need for component replacement, generally differs for each component in the machine. The ability to accurately predict wear of many components thus becomes even more difficult in machines adapted to process many different sizes as well as types of copy sheets.

It would be desirable, therefore, to be able to be able to accurately predict the wear of various components in a machine that processes a wide variety of copy sheets. It is an object, therefore, of the present invention to provide a technique to predict component wear based upon a consideration of the size or type of copy sheet processed. Another object of the present invention is to provide a technique to normalize processed sheet counts in a machine to a single standard to account for variations in the copy sheets processed. Other advantages of the present invention will become apparent as the following description proceeds, and the features characterizing the invention will be pointed out with particularity in the claims annexed to and forming a part of this specification.

SUMMARY OF THE INVENTION

The invention is concerned with normalizing the count in a counter depending upon the type or size of the copy sheets processed in an electronic image processing machine including the steps of determining the size or type of copy sheets in process in the machine, recording a count in the counter in response to the size or type of copy sheets in process, normalizing the count in the counter as a function of the change in size or type of the copy sheets in process, and relating the normalized counts to the need to replace selected components of the image processing machine.

For a better understanding of the present invention, reference may be had to the accompanying drawings wherein the same reference numerals have been applied to like parts and wherein:

DETAILED DESCRIPTION OF THE DRAWINGS

Figure 3:
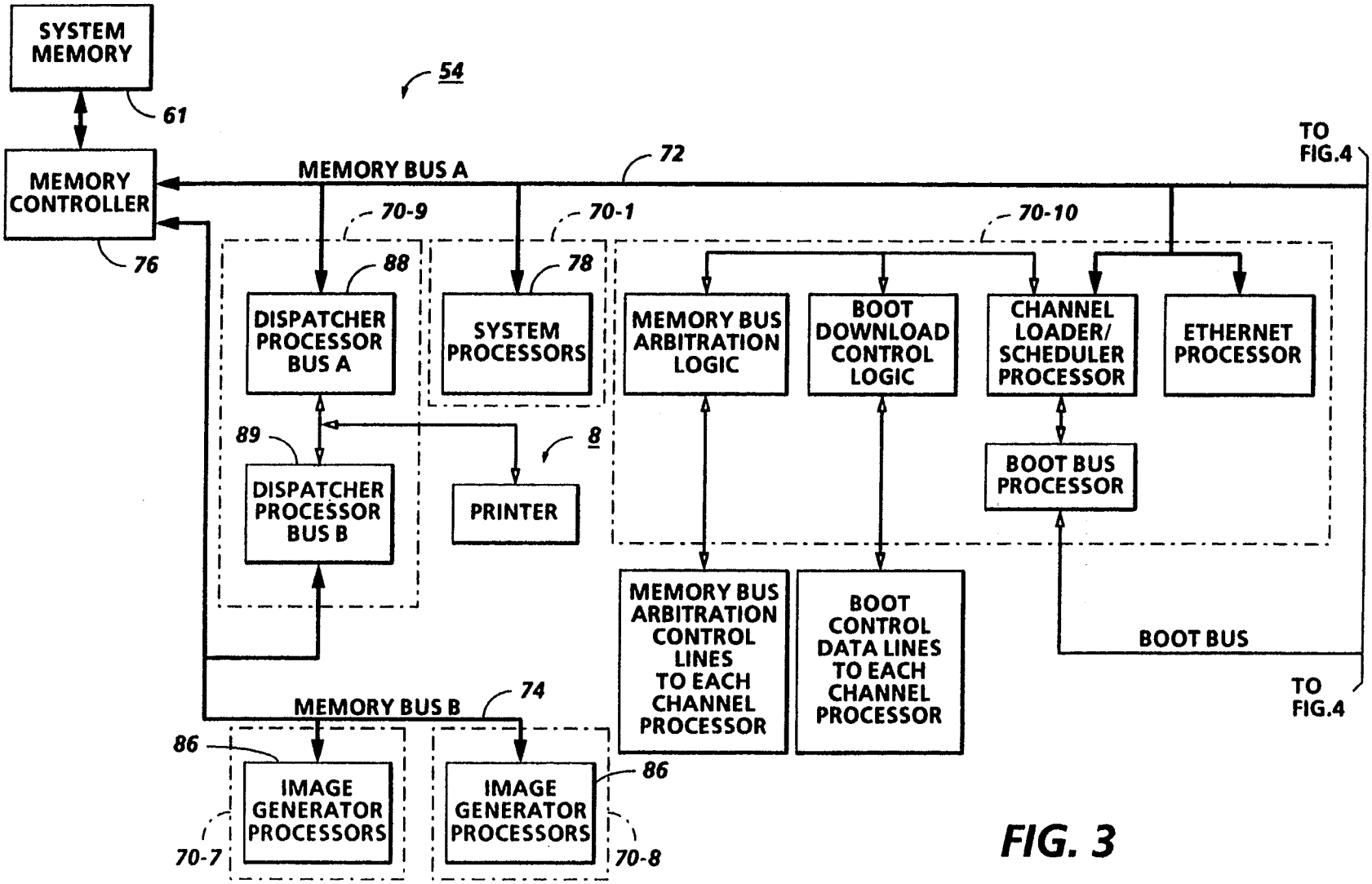
Figure 4:
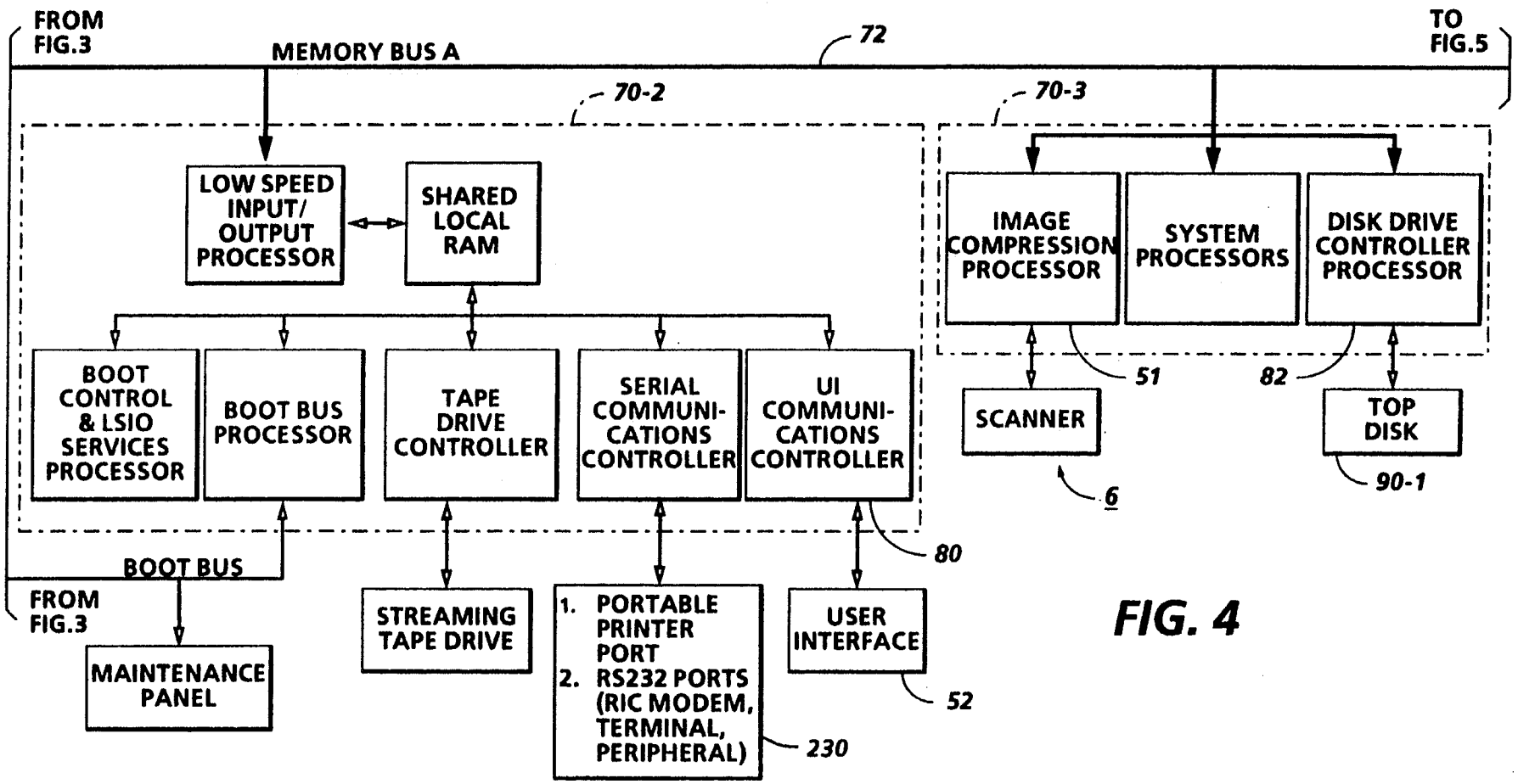
Figure 5:
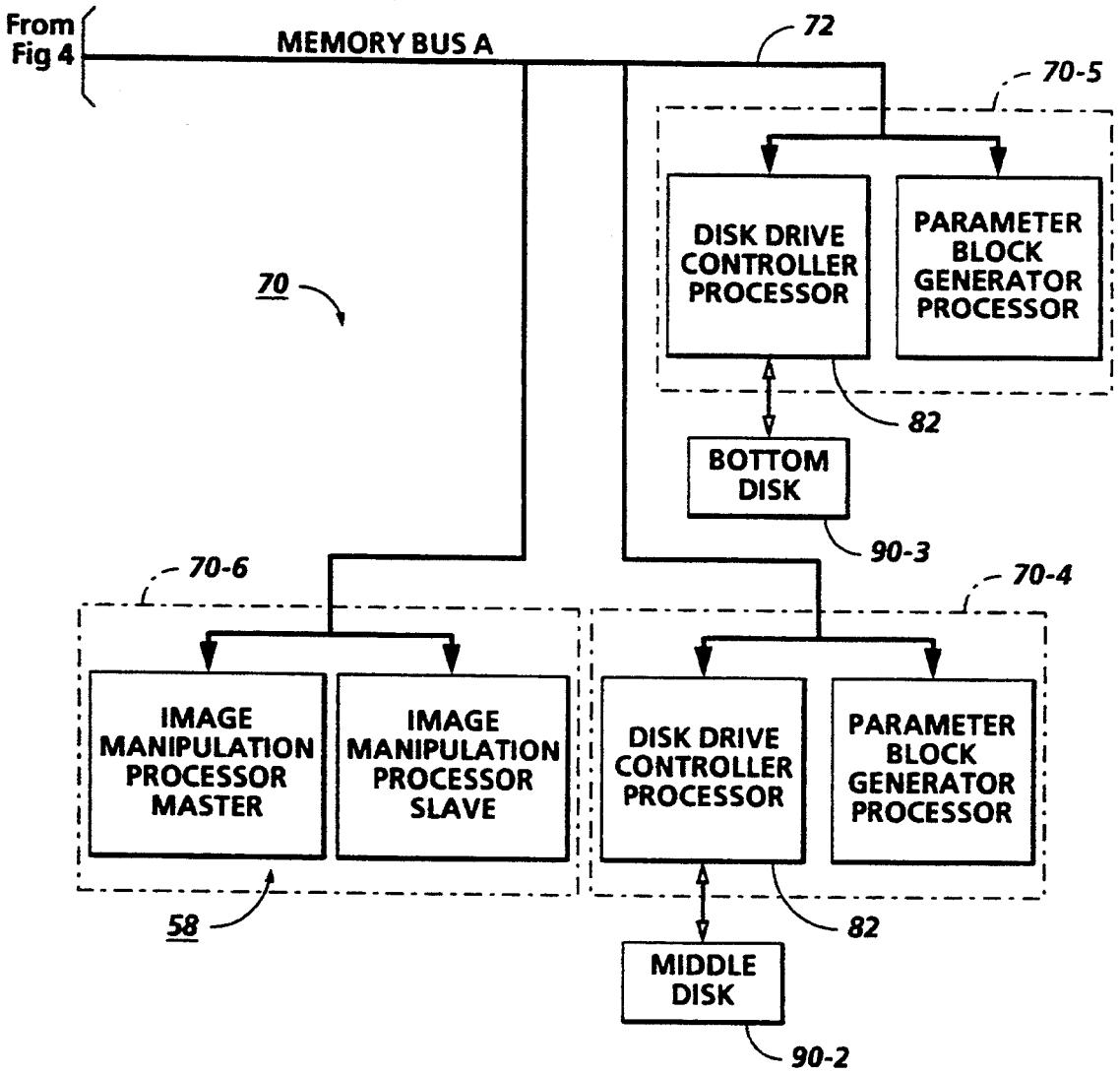
Figure 6:
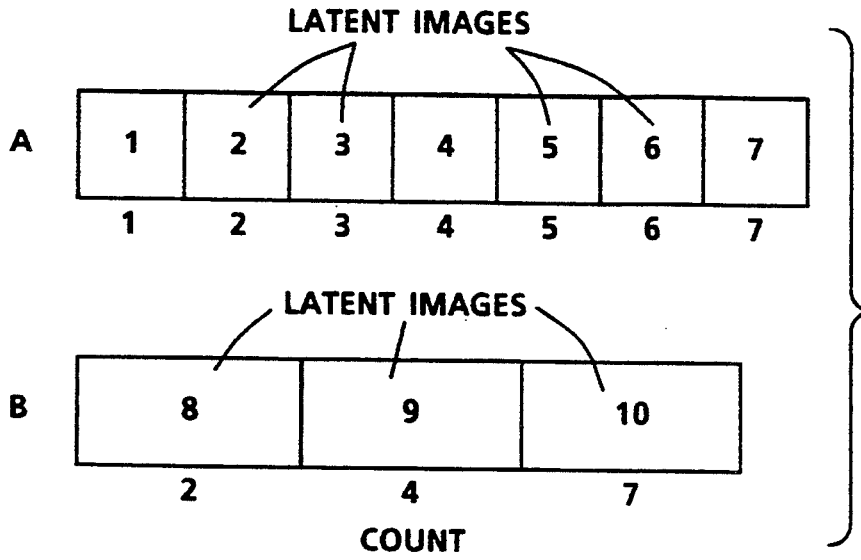
Figure 7:
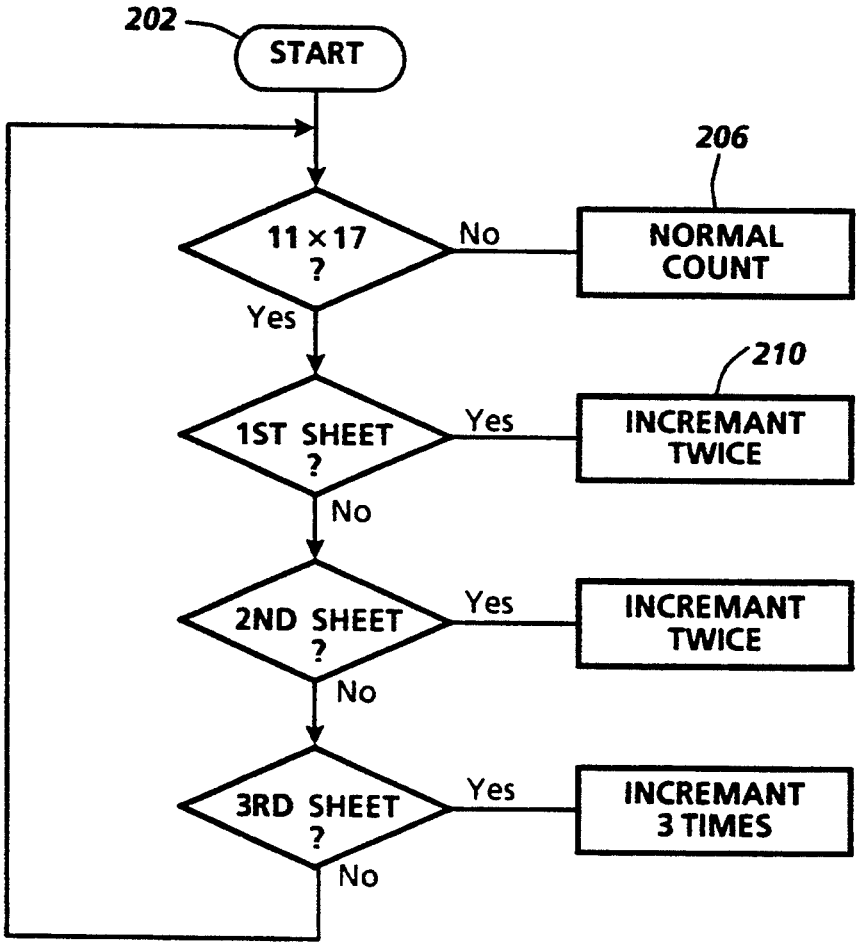
Figure 8:
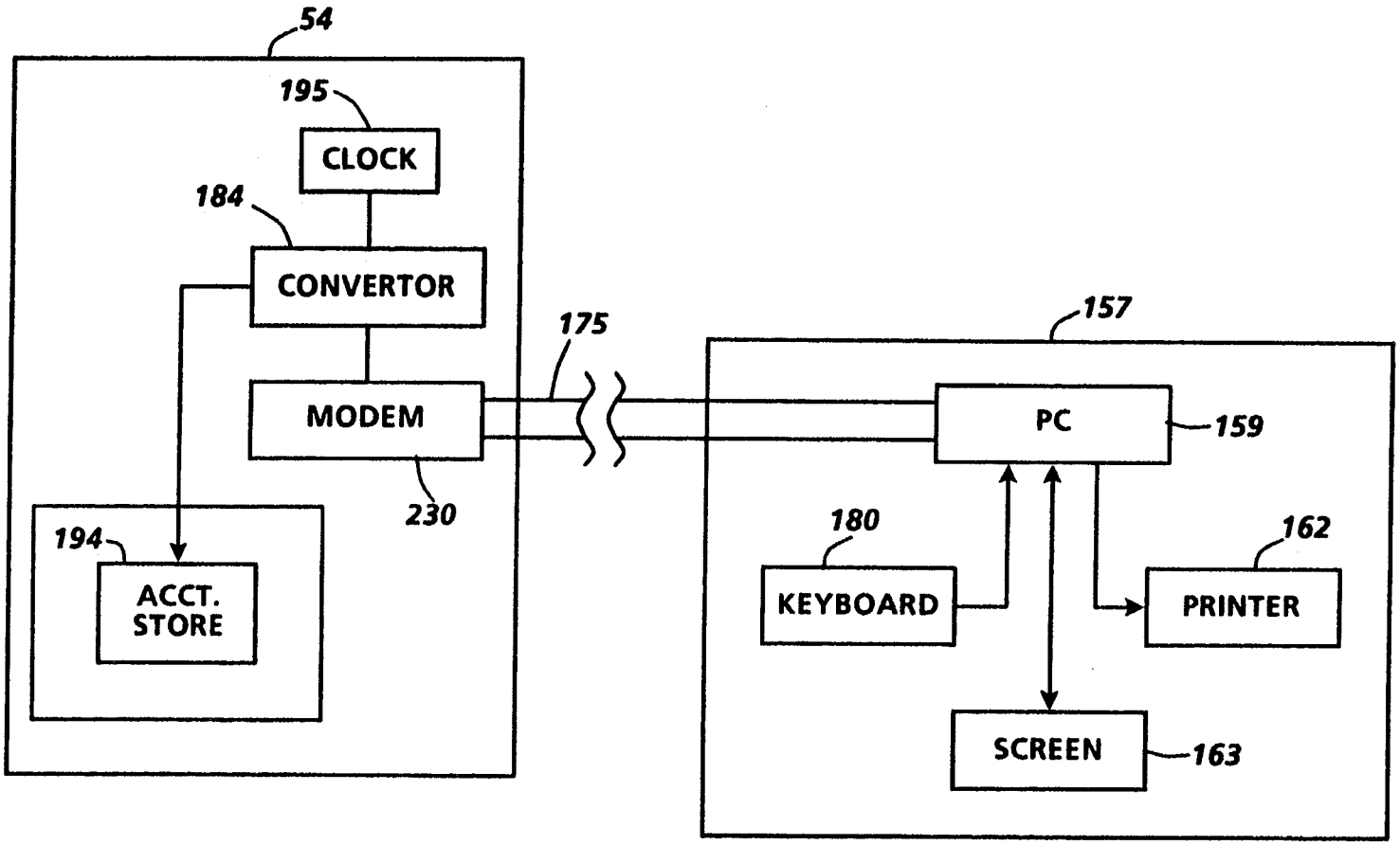

FIGS. 3, 4, and 5 comprise a schematic block diagram showing the major parts of the system control section;

FIG. 6 is a schematic illustrating the normalizing of sheet counts in accordance with the present invention;

FIG. 7 is a flow chart illustrating the normalizing of sheet counts in accordance with the present invention; and FIG. 8 illustrates a remote communication system for downloading normalized counts in accordance with the present invention.

DETAILED DESCRIPTION OF THE PREFERRED EMBODIMENT

Figure 1:
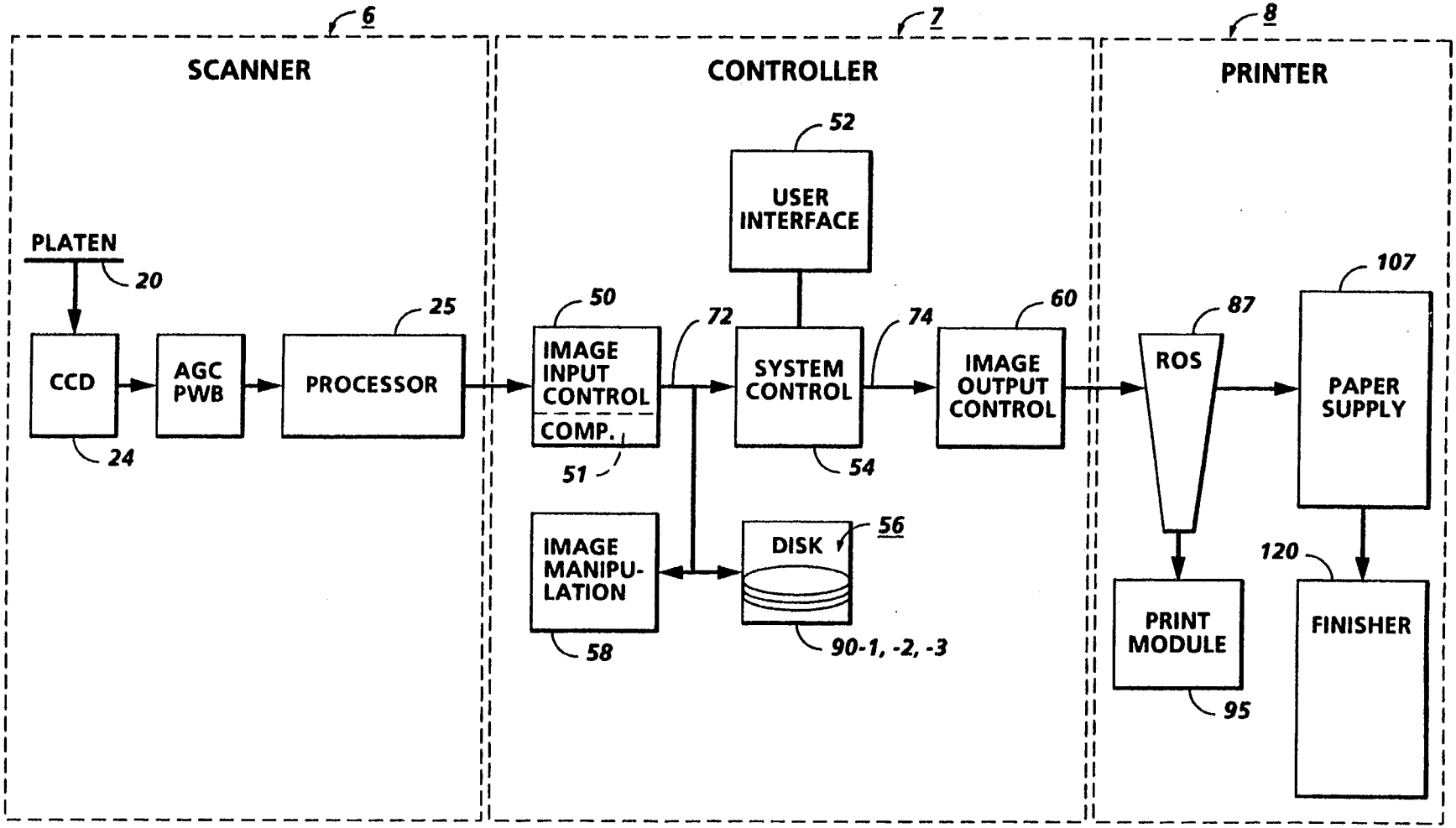
FIG. 1 is a block diagram depicting the major elements of a printing system incorporating the present invention.
Figure 2:
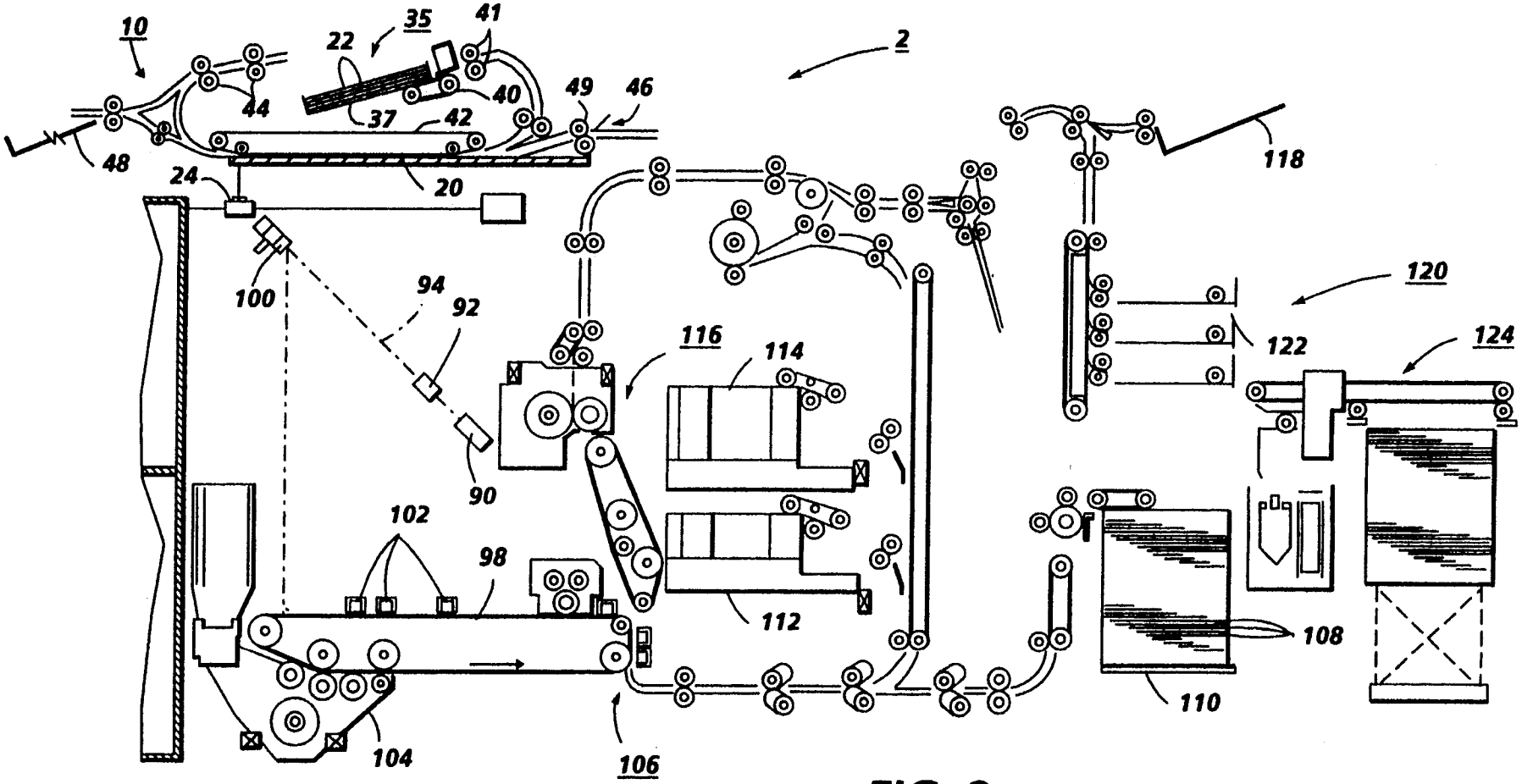
FIG. 2 is a plan view illustrating the principal mechanical components of the printing system shown in FIG. 1.

Referring to FIGS. 1 and 2, there is shown an exemplary laser based printing system 2 for processing print jobs in accordance with the teachings of the present invention. Printing system 2 for purposes of explanation is divided into a scanner section 6, controller section 7, and printer section 8. While a specific printing system is shown and described, the present invention may be used with other types of printing systems such as ink jet, ionographic, etc.

Scanner section 6 incorporates a transparent platen 20 on which the document 22 to be scanned is located. One or more linear arrays 24 are supported for reciprocating scanning movement below platen 20. Not shown lens and mirrors cooperate to focus array 24 on a line-like segment of platen 20 and the document being scanned thereon. Array 24 provides image signals or pixels representative of the image scanned which after suitable processing by processor 25, are output to controller section 7.

Processor 25 converts the analog image signals output by array 24 to digital and processes the image signals as required to enable system 2 to store and handle the image data in the form required to carry out the job programmed. Processor 25, for example, may provide enhancements and changes to the image signals such as filtering, thresholding, screening, cropping, etc.

Documents to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and document feed rolls 41 and document feed belt 42 onto platen 20 where the document is scanned by array 24. Following scanning, the document is removed from platen 20 by belt 42 and returned to tray 37 by document feed rolls 44.

For operation in the SADH mode, a document entry slot 46 provides access to the document feed belt 42 between tray 37 and platen 20 through which individual documents may be inserted manually for transport to platen 20. Feed rolls 49 behind slot 46 form a nip for engaging and feeding the document to feed belt 42 and onto platen 20. Following scanning, the document is removed from platen 20 and discharged into catch tray 48.

For operation in the manual mode, document handler 35 is pivoted upwardly to expose platen 20. This permits the document 22 to be manually placed on platen 20 following which array 24 is operated to scan the document. When scanning is completed, the document is removed to clear platen 20 for the next document. For Book mode, the book is manually positioned face down on platen 20 with the center line of the book aligned with positioning indicia (not shown) located along the border of platen 20. By programming the system, either one or both of the pages of the book open on the platen are scanned. The process is repeated for different pages of the book until all of the pages desired have been scanned following which the book is removed to clear platen 20.

For operation in the CFF mode, computer forms material is fed through slot 46 and advanced by feed rolls 49 to document feed belt 42 which in turn advances a page of the fanfold material into position on platen 20.

Printer section 8 comprises a laser type printer and for purposes of explanation is separated into a Raster Output Scanner (ROS) section 87, Print Module Section 95, Paper Supply section 107, and Finisher 120. ROS 95 has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotron 102 at a charging station preparatory to exposure by imaging beams 94.

The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112 or 114. The developed image transferred to the print media 108 is permanently fixed or fused by fuser 116 and the resulting prints discharged to either output tray 118, or to finisher 120. Finisher 120 includes a stitcher 122 for stitching or stapling the prints together to form books and a thermal binder 124 for adhesively binding the prints into books.

Referring to FIGS. 1, 2, 3, 4, and 5, controller section 7 is, for explanation purposes, divided into an image input controller 50, User Interface (UI) 52, system controller 54, main memory 56, image manipulation section 58 and image output controller 60.

The scanned image data input from processor 25 of scanner section 6 to controller section 7 is compressed by image compressor/processor 51 of image input controller 50 on PWB 70-3. As the image data passes through compressor/processor 51, it is segmented into slices N scanlines wide, each slice having a slice pointer. The compressed image data together with slice pointers and any related image descriptors providing image specific information (such as height and width of the document in pixels, the compression method used, pointers to the compressed image data, and pointers to the image slice pointers) are placed in an image file. The image files, which represent different print jobs, are temporarily stored in system memory 61 which comprises a Random Access Memory or RAM pending transfer to main memory 56 where the data is held pending use. Main memory 56 has plural hard disks 90-1, 90-2, 90-3 for storing machine Operating System software, machine operating data, and the scanned image data currently being processed.

When the compressed image data in main memory 56 requires further processing, or is required for display on touchscreen 62 of UI 52, or is required by printer section 8, the data is accessed in main memory 56. Where further processing other than that provided by processor 25 is required, the data is transferred to image manipulation section 58 on PWB 70-6 where the additional processing steps such as collation, make ready, decomposition, etc. are carried out. Following processing, the data may be returned to main memory 56, sent to UI 52 for display on touchscreen 62, or sent to image output controller 60.

Image data output to image output controller 60 is decompressed and readied for printing by image generating processors 86 of PWBs 70-7, 70-8. Following this, the data is output by dispatch processors 88, 89 on PWB 70-9 to printer section 8. Image data sent to printer section 8 for printing is normally purged from memory 56 to make room for new image data.

Referring particularly to FIGS. 3, 4, and 5 control section 7 includes a plurality of Printed Wiring Boards (PWBs) 70, PWBs 70 being coupled with one another and with System Memory 61 by a pair of memory buses 72, 74. Memory controller 76 couples System Memory 61 with buses 72, 74. PWBs 70 include system processor PWB 70-1 having system processors 78; low speed I/O processor PWB 70-2 having UI communication controller 80 for transmitting data to and from UI 52; PWBs 70-3, 70-4, 70-5 having disk drive controller/processors 82 for transmitting data to and from disks 90-1, 90-2, 90-3 respectively of main memory 56 (image compressor/processor 51 for compressing the image data is on PWB 70-3); image manipulation PWB 70-6 with image manipulation processors of image manipulation section 58; image generation processor PWBs 70-7, 708-8 with image generation processors 86 for processing the image data for printing by printer section 8; dispatch processor PWB 70-9 having dispatch processors 88, 89 for controlling transmission of data to and from printer section 8; and boot control-arbitration-scheduler PWB 70-10. For further details of a typical control system incorporating the present invention, reference is made to U.S. Pat. No. 5,200,960, incorporated herein.

The wear of hardware components in a machine is attributable to various factors such as the number of revolutions of the photoreceptor of the machine, as well as the amount or size of copy sheet paper driven past various stations of the machine such as the development and fuser stations. Consequently, statistics, such as the count of the copy sheets processed in a machine, do not always accurately reflect the strain on various components of the machine. For example, in one specific machine, seven 8.5×11 latent images can be carried on the photoreceptor. For example, in FIG. 4, strip A illustrates a machine photoreceptor such as photoreceptor 98, in FIG. 3, laid out end to end. Numbers 1 through 7 in strip A represent seven latent images projected from platen 20 onto distinct portions of the photoreceptor 98. Thus, for a single revolution of the photoreceptor belt 98, as many as seven latent images can be projected onto the photoreceptor to be transferred at transfer station 106 to seven distinct 8.5×11 copy sheets. Each copy sheet is then processed through fuser 116.

On the other hand, if 11×17 latent images and copy sheets are to be processed through the machine, only three 11×17 latent images can be projected onto the photoreceptor 98 as illustrated in strip B of FIG. 6, illustrated by images 8, 9 and 10. It can be seen that a photoreceptor can accommodate up to seven 8.5×11 images, but only three 11×17 latent images can be accommodated.

Thus, for each revolution of the photoreceptor, seven 8.5×11 copy sheets are processed through the fuser, and almost an equivalent amount of copy sheet area (although slightly less) of copy sheets are processed through the fuser for three 11×17 copy sheets. Yet, in recording the number of copy sheets processed, the count is seven for strip A and three for strip B. Thus, there would be substantially equivalent wear on the machine, yet in the instance of 11 by 17 sheets, only a count of 3 sheets compared to a count 7 sheets for 8.5 by 11 sheets. Thus, a reliance on sheet count alone does not provide an adequate measure of wear.

Expanding the analogy, 2100 sheets of 8.5×11 paper would cause a photoreceptor to complete 300 revolutions. On the other hand 2100 sheets of 11×17 paper would cause the photoreceptor to turn 700 revolutions. Thus, there would be a much more significant burden on the photoreceptor hardware for processing 11 by 17 sheets than processing the equivalent number of 8.5 by 11 copy sheets. Also, from the standpoint of the volume of copy sheet paper processed by the fuser, there is a much more significant stress on the fuser rolls for 2100 11×17 sheets than 2100 8.5 by 14 sheets.

In accordance with the present invention, applicants have set up a system to normalize the copy sheets counts to more accurately reflect the machine wear due to the processing of paper through the machine. One scenario, that has enabled the applicants to more accurately predict machine and component wear, is the following:

A counter in the control registers a count of 1 for each 8.5×11 copy sheet that is processed. However, for each 11×17 copy sheet that is processed the control increments the counter by two. However, every third 11×17 copy sheet in succession causes the control to increment the counter by three. Thus, for every three 11×17 sheets that pass through the fuser, the copy sheet counter reflects a set of count of seven rather than three. This is generally reflected in FIG. 6, showing a count of 1 through 7 for the 8.5×11 copy sheets and a count of 2, 4 and 7 after image 10 for the 11× 17 copy sheets. Thus, the normalized counts tend to regulate the volume of copy sheet material processed rather than a mere sheet count.

FIG. 7, illustrates this procedure in flow chart form. The machine cycles up as illustrated at block 202, and at decision block 204 (assuming there are only two possible images sizes 8.5×11 and 11×17), there is a determination whether or not there is a 11×17 image. If not, an 8.5×11 size is assumed and there is a normal count as shown at block 206. If an 11×17 is detected at block 208, there is a determination as to whether or not this is the first 11×17 copy sheet. If yes, as shown at block 210 the counter is incremented twice. If the 11×17 sheet is not the first sheet, then at block 212 there is a determination as to whether or not the 11×17 image or sheet is the second in succession. If yes, then at block 214 the counter is again incremented twice. Finally, if the 11×17 image is not the first or second in succession, there is a determination as to whether or not the 11×17 image is the third image or sheet in succession. If yes, then the counter is incremented three times as shown at block 218. If the 11×17 sheet is not the third in succession, then the routine loops back and automatically assumes the 11×17 is the first sheet or a second sequence.

It should be understood that the scope of the present invention is intended to cover various specific techniques and scenarios to adjust the counter and the control for various types and sizes of copy sheets, for example, in FIGS. 6 and 7, if in addition to 8.5×11 and 11×17 size copy sheets, there were also 11×14 size copy sheets suitable normalizing steps could be programmed into the control. It should also be understood that although the above described procedure is generally applicable to a machine fuser, the manner of adjusting the count in the counter could be suitably adjusted for other types of machine components as well. For example, if component wear is more accurately a function of photoreceptor revolutions, then the counter could simply reflect revolutions rather than copy sheet numbers. It should also be understood that if, for example, copy sheet counts are the standard reference, the counts could be normalized in a different manner for different components.

With reference to FIG. 8, in accordance with another aspect of the present invention, there is a shown a remote communications systems including remote host 157 interconnected to control 54 of machine 2 through a suitable channel such as telephone line 175 or any other suitable channel such as local and wide area networks, cellular phone channels, infrared links, and serial channels such as RS 232 ports. Normalized counts stored in any suitable buffer or accounts store 194 can be downloaded to remote host 157 for component tracking and diagnostics. Remote host 157 could include a suitable expert system for sophisticated analysis and tracking of component wear and scheduling appropriate maintenance, or simply could be a less sophisticated central station for recording and monitoring machine usage. It should also be understood that raw copy count data could be transmitted from the machine to the remote host 157 for normalizing an adjustment rather than having control 54 perform these operations.

A communication modem 230 as generally shown in FIG. 4 connects line 175 to machine 2 for transmission of the normalized counts from machine to the remote host 157. A computer such as PC 159 with suitable input such as keyboard 180 is provided at the remote host 157 for use in establishing communication with modem 230 for transmission of data from machine 2 via line 175 to host 157 and from host 157 to machine 2. A suitable data band with converter 184 converts data to clock rate required for transmission over line 175, it being understood that the rate at which data is handled by machine 2 is ordinarily different and typically substantially greater than the data transmission rate of telephone line 175. In this regard, a clock 195 is connected to converter 184.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an electronic image processing machine having a plurality of image processing components including a controller for producing images on copy sheets of varying size, one of the processing components being a photosensitive member for supporting latent images of varying sizes, the size of the latent image being defined as the machine pitch, the controller including a device for counting the number of copy sheets processed, the method of normalizing the count in the device depending upon the pitch of the machine comprising the steps of:

determining the pitch of images in process, recording a count in the counter in response to the pitch of images in process, and normalizing the count in the counter as a function of the change in pitch of the images in process.

2. The method of claim 1 wherein the step of normalizing the count is a function of the number of successive images of a given pitch.

3. In an electronic image processing apparatus having a plurality of image processing components including a controller for producing images on copy sheets of varying size, the controller including a counter for recording copy sheets processed, the wear of the components being related to the size of copy sheets, the method of adjusting the count in the counter depending the size of the copy sheet as a measure of the wear of selected components comprising the steps of:

recording a first count in the counter in response to a first size copy sheet, and recording a second count in the counter in response to a second size copy sheet, the second count in the counter in response to a second size copy sheet being a function of the ratio of the first size copy sheet to the second size copy sheet in order to predict the wear of said selected components.

4. The method of claim 3 wherein the second count is a function of the number of successive second size copy sheets in process.

5. The method of claim 3 including the step of recording a third count in the counter in response to a third size copy sheet.

6. In an electronic image processing machine having a plurality of image processing components including a controller for producing images on copy sheets of varying size, the controller including a device for counting the number of copy sheets processed, the method of normalizing the count in the device depending upon the size of the copy sheets processed comprising the steps of:

determining the size of copy sheets in process, recording a count in the counter in response to the size of copy sheets in process, and normalizing the count in the counter as a function of the change in size of the copy sheets in process.

7. An electronic image processing machine having a plurality of image processing components including a controller for producing images on copy sheets of varying size comprising:

a counter interconnected to the controller for counting copy sheets in process including, means for recording a count in the counter in response to a copy sheet in process, a sensor for determining the size of a copy sheet in process, and logic means for normalizing the count in the counter as a function of the change in size of the copy sheets in process being sensed by the sensor.

8. In an electronic image processing machine having a plurality of image processing components including a controller for producing images on copy sheets of varying size, the controller including a device for counting the number of copy sheets processed, the controller being interconnected to a remote station over a network, the method of transmitting usage data to the remote station comprising the steps of:

determining the size of copy sheets in process, recording a count in the counter in response to the size of copy sheets in process, normalizing the count in the counter as a function of the change in size of the copy sheets in process, and transmitting the normalized count to the remote station.

9. The method of claim 8 wherein the remote station includes a display for analyzing said normalized count.

10. In an electronic image processing machine having a plurality of image processing components including a controller for producing images on copy sheets of varying size, the controller including a device for counting the number of copy sheets processed, the controller being interconnected to a remote station over a network, the method of transmitting usage data to the remote station comprising the steps of:

determining the size of copy sheets in process, recording a count in the counter in response to the size of copy sheets in process, transmitting the count to the remote station, and normalizing the count in the counter at the remote station as a function of the change in size of the copy sheets in process.

11. In an electronic image processing machine having a plurality of image processing components including a controller for producing images on various types of copy sheets, the controller including a device for counting the number of copy sheets processed, the method of normalizing the count in the device depending upon the type of the copy sheets processed comprising the steps of:

determining the type of copy sheets in process, recording a count in the counter in response to the type of copy sheets in process, and normalizing the count in the counter as a function of the change in type of the copy sheets in process.

12. The method of claim 11 including the step of relating the count in the counter to a threshold count for each of the image processing components.

13. The method of claim 11 wherein the threshold count for each of the image processing components is different.

14. The method of claim 12 including the step of manifesting that the count in the counter exceeds the threshold count for a given component.

15. The method of claim 1 wherein the step of manifesting includes the step of displaying the count in the counter.

* * * * *